United States Patent [19]

Kohtaroh et al.

[11] Patent Number: 4,830,731

[45] Date of Patent: May 16, 1989

[54] PASSIVATORS USED IN CATALYTIC CRACKING OF HYDROCARBONS

[75] Inventors: Fujita Kohtaroh; Wachi Toshio; Nakano Hitomi, all of Sakai, Japan

[73] Assignee: Sakai Chemical Industry Co., Ltd., Sakai, Japan

[21] Appl. No.: 177,348

[22] Filed: Apr. 1, 1988

Related U.S. Application Data

[63] Continuation of Ser. No. 90,452, Aug. 28, 1987, abandoned.

[51] Int. Cl.[4] ..... C10G 11/00

[52] U.S. Cl. ..... 208/113; 208/106; 208/108

[58] Field of Search ..... 208/113, 106, 108

[56] References Cited

U.S. PATENT DOCUMENTS

| | | | |
|---|---|---|---|
| 2,510,738 | 6/1950 | Clemence et al. | 208/113 |
| 4,111,845 | 9/1978 | McKay | 208/113 |
| 4,153,536 | 5/1979 | McKay | 208/113 |
| 4,257,919 | 3/1981 | Roberts et al. | 208/113 |
| 4,263,130 | 4/1981 | Bertus et al. | 208/113 |
| 4,279,735 | 7/1981 | Bertus et al. | 208/113 |
| 4,507,398 | 3/1985 | Boston | 208/113 |

FOREIGN PATENT DOCUMENTS

| | | | |
|---|---|---|---|
| 63-633689 | 3/1988 | Japan | 208/113 |
| 63-63688 | 3/1988 | Japan | 208/113 |

OTHER PUBLICATIONS

Chemical Abstracts, vol. 59, 9327e, pp. 9327–9328 (1955).

*Primary Examiner*—Asok Pal

*Attorney, Agent, or Firm*—Wegner & Bretschneider

[57] ABSTRACT

A passivator of detrimental metals such as nickel, vanadium or iron that are contained in hydrocarbons and deteriorate catalysts in catalytic cracking of hydrocarbons, which has the general formula of $$Sb(-S-R^1)_3$$

wherein $R^1$ represents as alkyl of 4–14 carbons.

A further passivator which has the general formula of $$Sb(-S-(CH_2)_n-COOR^2)_3$$

wherein $R^2$ represents an alkyl of 4–14 carbons, and n is an integer of 1 or 2.

3 Claims, No Drawings

PASSIVATORS USED IN CATALYTIC CRACKING OF HYDROCARBONS

This application is a continuation of Ser. No. 090,452, filed Aug. 28, 1987, now abandoned.

This invention relates to passivators used in catalytic cracking of hydrocarbons, and a method of catalytic cracking of hydrocarbons.

More particularly, the invention relates to antimony mercaptides used in cracking of hydrocarbons in the presence of catalysts to passivate a certain group of detrimental metals such as nickel, vanadium or iron that are contained in the hydrocarbons and adversely affect the catalysts, so as to deactivate the metals and ensure high yields of production of gasoline and other valuable fractions.

The invention further relates to a method of catalytic cracking of hydrocarbons wherein detrimental metals deposited on cracking catalysts are passivated or deactivated with antimony mercaptides so that the catalysts are capable of retaining desired catalytic activity in catalytic cracking of hydrocarbons.

It is well known that a certain group of detrimental metals such as nickel, vanadium or iron are contained in hydrocarbon feedstocks, and the deposition of such metals on cracking catalysts causes the deterioration of the catalysts in catalytic cracking of hydrocarbons, and increases the production of undesired products such as hydrogen and coke, thereby to decrease the yields of more valuable products such as gasoline.

Therefore, a variety of methods have been proposed to passivate or deactivate such metals by use of so-called passivators that are compounds of antimony, indium or bismuth, thereby to prevent the deterioration of cracking catalysts with the metals, as disclosed in U.S. Pat. Nos. 4,111,845, 4,153,536, and 4,257,919, and Japanese Patent Disclosure No. 53-104588 and No. 57-34188.

A diversity of compounds are known to be useful as passivators, and it is generally accepted that antimony compounds are the most useful. As such antimony compounds are known, for example, antimony oxide, antimony carboxylate, antimony thiocarboxylate, antimony sulfonate, antimony carbamate, antimony thiocarbamate, antimony phosphite, antimony phosphate and antimony thiophosphate, as disclosed in U.S. Pat. No. 4,111,845 and Japanese Patent Disclosure No. 53-104588. In use of these antimony compounds as passivators in catalytic cracking of hydrocarbons, they are added to feed-stocks to be cracked, or impregnated into cracking catalysts that are usually composed of silica-alumina.

However, such antimony compounds as heretofore known have not a few disadvantages in that, for example, they are not sufficiently soluble in hydrocarbons so that they often fail to sufficiently passivate the detrimental metals, or they are rather unstable and deposit during storage.

It is, therefore, an object of the invention to provide novel passivators composed of antimony mercaptides which are stable during storage, but also highly soluble in hydrocarbons, and accordingly more satisfactorily passivate detrimental metals such as nickel, vanadium or iron that adversely affect a cracking process of hydrocarbons.

It is a further object of the invention to provide a method of catalytic cracking of hydrocarbons wherein such detrimental metals are passivated with antimony mercaptides, thereby to ensure high yields of the production of gasoline and other valuable fractions.

According to the invention, there is provided a passivator of detrimental metals such as nickel, vanadium or iron that are contained in hydrocarbons and deteriorate catalysts in catalytic cracking of hydrocarbons, which has the general formula of $$Sb(-S-R^1)_3 \quad (I)$$

wherein $R^1$ represents an alkyl or 4–14 carbons.

According to the invention, there is provided a further passivator, which has the general formula of $$Sb(-S-(CH_2)_n-COOR^2)_3 \quad (II)$$

wherein $R^2$ represents an alkyl or 4–14 carbons, and n is an integer of 1 or 2.

The first group of antimony mercaptides having the general formula (I) are already known, as described in U.S. Pat. No. 2,510,738, and may be produced by the reaction of antimony trichloride or antimony oxide with organic mercaptans.

The first group of antimony mercaptides include, for example, antimony tris(mercaptoisobutyl), antimony tris-(mercapto-t-butyl), antimony tris(mercapto-n-pentyl), antimony tris(mercapto-n-hexyl), antimony tris(-mercapto-n-octyl), antimony tris(mercapto-2-ethylhexyl), antimony tris-(mercapto-n-dodecyl), antimony tris(mercapto-t-dodecyl), antimony tris(mercapto-n-tetradecyl) and antimony tris-(mercapto-t-tetradecyl).

The second group of antimony mercaptides having the general formula (II) are also already known, as described in Chemical Abstracts, Vol. 49, 9327e (1955).

The second group of antimony mercaptides include, for example, antimony tris(n-butylthioglycolate), antimony tris(t-butylthioglycolate),antimony tris(n-pentylthio-glycolate), antimony tris(n-hexylthioglycolate), antimony tris(n-octylthioglycolate), antimony tris(2-ethylhexyltio-glycolate), antimony tris(t-nonylthioglycolate), antimony tris(n-decylthioglycolate), antimony tris(isodecylthio-glycolate), antimony tris(n-dodecylthioglycolate), antimony tris(t-dodecylthioglycolate), antimony tris(n-tetradecylthio-glycolate), antimony tris(t-tetradecylthioglycolate), when n is 1 in the formula (II); and antimony tris(n-butyl-3-mercapto-propionate), antimony tris(t-butyl-3-mercapto-propionate), antimony tris(n-pentyl-3-mercaptopropionate), antimony tris(n-hexyl-3-mercaptopropionate), antimony tris(n-octyl-3-mercaptopropionate), antimony tris(2-ethyl-hexyl-3-mercaptopropionate), antimony tris(t-nonyl-3-mercapto-propionate), antimony tris(n-decyl-3-mercapto-propionate), antimony tris(t-decyl-3-mercapto-propionate), antimony tris(n-dodecyl-3-mercaptopropionate), antimony tris(t-dodecyl-3-mercapto-propionate), antimony tris(n-tetradecyl-3-mercapto-propionate), and antimony tris(t-tetradecyl-3-mercapto-propionate), when n is 2 in the formula (II).

The antimony mercaptides may be used alone or in any combination thereof. In use of the antimony mercaptides as passivators in catalytic cracking of hydrocarbons, the mercaptides are usually carried on a catalyst to be used or added to hydrocarbons to be cracked.

The catalytic cracking of hydrocarbons is carried out usually at temperatures of about 500°–600°C., whereas the above antimony mercaptides as passivators usually decompose at those temperatures. It is likely that the antimony mercaptides are thermally decomposed in the cracking of hydrocarbons and the resultant antimony remaining on the catalyst passivates the metals such as nickel, vanadium or iron deposited on the catalyst during the cracking of hydrocarbons, although the definite mechanism of the passivation of the metals has not yet been clarified.

The amount of passivators used in the catalytic cracking of hydrocarbons depends upon the amount of the metals such as nickel, vanadium or ion in the hydrocarbons, the reaction conditions, and others. Therefore, the amount of antimony mercaptides used is not specifically limited, but usually the amount is in the range of about 0.1-2% by weight in terms of weight of antimony based on the weight of a catalyst used when the antimony mercaptides are carried on or impregnated into the catalyst, whereas the amount is in the range of about 1-10000 ppm, preferably in the range of about 10-1000 ppm, in terms of weight of antimony, based on the weight of hydrocarbons to be cracked when the antimony mercaptides are added to the hydrocarbons.

The antimony mercaptides according to the invention may be used as passivators in any catalytic cracking of hydrocarbons ever known, in which, for example, petroleum hydrocarbon feedstocks such as light oil are heated to temperatures of about 500°-600° C. in the presence of a catalyst, to produce gasoline, liquefied petroleum gas, alkylation materials, and the other intermediate fractions. However, the antimony mercaptides according to the invention are not limited in use as passivators to the above exemplified process, but are applicable also to many other processes that have had increasing importance in recent years.

Therefore, the antimony mercaptides according to the invention are also applicable, for example, to a fluid catalytic cracking process of heavy oils which include distillation residue. The heavy oils include, for example, crude petroleum, residual oils after atmospheric or reduced pressure distillation of crude petroleum, and desulfurized oils. Since these heavy oils contain therein a relatively large amount of the metals as before mentioned, they can be suitably cracked in the presence of the antimony mercaptides according to the invention.

The antimony mercaptides according to the invention are superior to conventional antimony compounds as passivators of the metals in the catalytic cracking of hydrocarbons, since they are more soluble in hydrocarbons, and passivate the metals more effectively than the conventional passivators, thereby to permit the production of desired products such as gasoline in higher yields, suppressing the production of undesired hydrogen and coak. Furthermore, the antimony mercaptides according to the invention are stable over a long period storage.

The invention will be more easily understood with reference to the following examples, which however are intended to illustrate the invention only and are not to be construed to limiting the scope of the invention.

EXAMPLE 1

The Middle Eastern petroleum atmospheric distillation residue containing 50 ppm of nickel, 200 ppm of vanadium and 10% by weight of residual carbons was catalytically cracked in the presence of a silica-alumina catalyst containing 5% by weight of zeolites in a fluid catalytic cracking pilot plant, to deposit nickel and vanadium on the catalyst. The catalyst was taken out of the plant, analyzed, and was found to contain 2300 ppm of nickel and 7000 ppm of vandium.

The antimony mercaptides as shown in Table 1 were added, respectively, in amounts of 100 ppm in terms of weight of antimony to the same distillation residue as above, and then the residue was each cracked in the presence of the catalyst thus having the metals deposited thereon in a fixed bed microreactor, to determine the activity of the catalyst. The results are shown in Table 1.

REFERENCE EXAMPLE 1

The same distillation residue as in Example 1 was cracked without adding antimony mercaptides thereto and otherwise in the same conditions as in Example 1. The results are shown in Table 1.

EXAMPLE 2

The antimony mecaptide as shown in Table 1 was impregnated in amounts of 0.8% by weight in terms of weight of antimony into a silica-alumina fluid cracking catalyst containing about 5% by weight of zeolites by spraying the antimony mercaptide onto the catalyst.

The catalyst was placed in the same reactor as in Example 1, and the same distillation residue as in Example 1 was cracked in the presence of the catalyst for 100 hours, to determine the activity of the catalyst. The results are shown in Table 1.

REFERENCE EXAMPLE 2

The same distillation residue as in Example 1 was cracked in the presence of the same catalyst as in Example 2 but having no antimony mercaptide impregnated thereinto otherwise in the same conditions as in Example 2. The activity of the catalyst is shown in Table 1.

EXAMPLE 3

The Middle Eastern petroleum atmospheric distillation residue containing 50 ppm of nickel, 200 ppm of vanadium and 10% by weight of residual carbons was catalytically cracked in the presence of a silica-alumina catalyst containing 5% by weight of zeolites in a fluid catalytic cracking pilot plant, to deposit nickel and vanadium on the catalyst. The catalyst was taken out of the plant, analyzed, and was found to contain 2300 ppm of nickel and 7000 ppm of vanadium.

The antimony mercaptides as shown in Table 2 were added, respectively, in amounts of 100 ppm in terms of weight of antimony to the same distillation residue as above, and then the residue was each cracked in the presence of the catalyst thus having the metals deposited thereon in a fixed bed microreactor, to determine the activity of the catalyst. The results are shown in Table 2.

REFERENCE EXAMPLE 3

The same distillation residue as in Example 3 was cracked without adding antimony mercaptides thereto and otherwise in the same conditions as in Example 3. The results are shown in Table 2.

EXAMPLE 4

The antimony mercaptide as shown in Table 2 was impregnated in amounts of 0.8% by weight in terms of weight of antimony into a silica-alumina fluid cracking catalyst containing about 5% by weight of zeolites by spraying the antimony mercaptide onto the catalyst.

The catalyst was placed in the same reactor as in Example 3, and the same distillation residue as in Example 3 was cracked in the presence of the catalyst for 100 hours, to determine the activity of the catalyst. The results are shown in Table 2.

TABLE 1

| | Runs | Passivators: Formulas | Passivators: Sb Contents (% by weight) | Microreactor Experiments: Conversions (% by weight) | Microreactor Experiments: Carbon Productions (C.P.F.) | Microreactor Experiments: Hydrogen Productions ($H_2/CH_4$ ratios) |
|---|---|---|---|---|---|---|
| Example 1 | 1 | $Sb(—S—C_8H_{17})_3$* | 19.5 | 65 | 2.0 | 0.9 |
| | 2 | $Sb(—S—t\text{-}C_{12}H_{25})_3$ | 15.1 | 57 | 2.5 | 1.0 |
| Reference 1 | 3 | — | — | 45 | 6.4 | 3.4 |
| Example 2 | 4 | $Sb(—S—t\text{-}C_{12}H_{25})_3$ | 15.1 | 58 | 2.3 | 1.5 |
| Reference 2 | 5 | — | — | 40 | 7.0 | 4.0 |

Notes
*$C_8H_{17}$— is n-octyl.

TABLE 2

| | Runs | Passivators: Formulas | Passivators: Sb Contents (% by weight) | Microreactor Experiments: Conversions (% by weight) | Microreactor Experiments: Carbon Productions (C.P.F.) | Microreactor Experiments: Hydrogen Productions ($H_2/CH_4$ ratios) |
|---|---|---|---|---|---|---|
| Example 3 | 1 | $Sb(—S—C_2H_4—COOC_8H_{17})_3$* | 13.2 | 60 | 2.1 | 1.0 |
| | 2 | $Sb(—S—CH_2—COOC_8H_{17})_3$* | 14.0 | 64 | 1.9 | 0.9 |
| | 3 | $Sb(—S—C_2H_4—COOC_4H_9)_3$ | 18.5 | 67 | 2.1 | 1.0 |
| Reference 3 | 4 | — | — | 45 | 6.4 | 3.4 |
| Example 4 | 5 | $Sb(—S—C_2H_4—COOC_8H_{17})_3$* | 13.2 | 63 | 2.2 | 1.2 |
| Reference 4 | 6 | — | — | 40 | 7.0 | 4.0 |

Notes
*$C_8H_{17}$— is 2-ethylhexyl.

REFERENCE EXAMPLE 4

The same distillation residue as in Example 3 was cracked in the presence of the same catalyst as in Example 3 but having no antimony mercaptide impregnated thereinto otherwise in the same conditions as in Example 3. The activity of the catalyst is shown in Table 2.

EXAMPLE 5

An amount of 1 g of antimony tris(mercapto-t-dodecyl) containing 15.1% by weight of antimony and 1 g of antimony tris(mercapto-n-octyl) containing 19.5% by weight of antimony was added, respectively, to 100 g of a mixture of heavy oil A and light oil in a 30/70 weight ratio at normal temperatures, and stirred. The antimony mercaptides were found to readily dissolve therein, respectively.

However, antimony tris(thioacetate) containing antimony in amounts of 35% by weight was found insoluble in the above mixture.

What is claimed is:

1. A method of catalytic cracking of hydrocarbons which comprises:

cracking hydrocarbons with a catalyst in the presence of antimony tris(2-ethylhexylthioglycolate).

2. A method as claimed in claim 1, wherein the antimony mercaptides are impregnated into the cracking catalyst in amounts of about 0.1–2% by weight in terms of weight of antimony based on the weight of the catalyst.

3. A method as claimed in claim 1, wherein the antimony mercaptides are added to the hydrocarbons in amounts of about 1–10000 ppm in terms of weight of antimony based on the weight of the hydrocarbons.

* * * * *